US005384076A

United States Patent [19]

Sato et al.

[11] Patent Number: 5,384,076

[45] Date of Patent: Jan. 24, 1995

[54] RESISTIVE FILM-FORMING COMPOSITION AND ELECTRONIC COMPONENTS USING THE SAME

[75] Inventors: Katsuhiro Sato; Kaoru Torikoshi; Hiroyuki Tanaka; Fumiaki Tambo; Yutaka Akasaki, all of Minami Ashigara, Japan

[73] Assignee: Fuji Xerox Co., Ltd., Tokyo, Japan

[21] Appl. No.: 844,853

[22] Filed: Mar. 3, 1992

[30] Foreign Application Priority Data

Mar. 7, 1991 [JP] Japan ..... 3-041679

[51] Int. Cl.[6] ..... H01B 1/00

[52] U.S. Cl. ..... 252/518; 252/514; 106/1.24; 106/1.28; 556/136; 420/461

[58] Field of Search ..... 252/514, 518, 521; 106/1.24, 1.28; 556/136; 420/461

[56] References Cited

U.S. PATENT DOCUMENTS 5,001,598 3/1991 Constantine ..... 252/520
5,122,777 6/1992 Shiratsuki et al. ..... 252/512

FOREIGN PATENT DOCUMENTS 64-54710 3/1989 Japan .
1220402 9/1989 Japan .
1-286401 11/1989 Japan .

OTHER PUBLICATIONS

*Journal of Inorganic Chemistry,* 34, 253 (1988).
*Materials Res. Soc. Symp. Proc.,* 60, 35 (1986).
*Inorganic Chemistry* 15(11), 2936 (1976).

*Primary Examiner*—Paul Lieberman
*Assistant Examiner*—M. Kopec
*Attorney, Agent, or Firm*—Oliff & Berridge

[57] ABSTRACT

A resistive film-forming composition to be coated on a substrate and calcined to form a resistive film is disclosed, which contains an organic iridium compound selected from a compound represented by formula (I):

(I)

wherein $R^1$ represents a hydrogen atom, an alkyl group, or an alkoxy group, a compound represented by formula (II):

$$Ir(R^4COCR^3COR^5)_3$$

wherein $R^3$ represents a hydrogen atom or an alkyl group; and $R^4$ and $R^5$ each represent an alkyl group. A uniform resistive film having excellent electrical characteristics can be formed with good adhesion to a substrate.

11 Claims, 1 Drawing Sheet

RESISTIVE FILM-FORMING COMPOSITION AND ELECTRONIC COMPONENTS USING THE SAME

FIELD OF THE INVENTION

This invention relates to a resistive film-forming composition for fabricating a resistive element for use in various electronic components, such as hybrid IC and thermal heads and to an electronic component using the same.

BACKGROUND OF THE INVENTION

Current techniques for fabrication of a resistive film include thick film formation and thin film formation. The thin film formation is a process of forming a resistive film on an insulating substrate by deposition or sputtering in a vacuum chamber. This process is capable of forming a thin and uniform resistive film but requires large-scale production equipment, resulting in high cost.

The thick film formation is a process consisting of coating or printing a resistive film-forming paste on an insulating substrate followed by calcining. This process achieves high productivity with inexpensive equipment and at low cost, but the resistive films obtained by most of the frequently employed thick film formation techniques generally have a large film thickness and accordingly have a great heat capacity. Moreover, comprised of a sintered body of particles having an particle size of micron-meter order, the resulting resistive film not only suffers from large variation in resistivity but has poor strength in electric field. A thermal head using such a resistive film as a heating element involves a large energy consumption and exhibits poor thermal response and easily changeable resistivity.

A number of proposals have hitherto been made for the production of a thin resistive film by exploiting the thick film formation technique with inexpensive production equipment. One of these proposals is a metallo-organic deposition (MOD) process, in which a solution containing an organometallic compound is coated on a substrate, followed by calcining to decompose the compound to form a thin film comprising the corresponding metal oxide, etc. Reference can be made in JP-A-64-54710, JP-A-1-286401, and JP-A-1-220402 (the term "JP-A" as used herein means an "unexamined published Japanese patent application"). While an organic iridium compound is commercially available in the form of metal resinate for a resistive film-forming composition in the MOD process, the thin resistive film obtained by the MOD process using the known metal resinate of iridium compound still have unsatisfactory uniformity of film thickness, surface defects such as cracks or pinholes, and insufficient adhesion to the substrate. In addition, the organic iridium compounds known applicable to the MOD process are limited and expensive.

SUMMARY OF THE INVENTION

An object of the present invention is to provide an organic iridium compound which can be applied to the MOD process to provide a resistive film which is free from cracks or pinholes and has sufficient adhesion to a substrate.

Another object of the present invention is to economically provide a resistive film which is free from cracks or pinholes and has sufficient adhesion to a substrate.

A further object of the present invention is to economically provide an electronic part, e.g., a thermal head, using such a resistive film.

It has now been found that the above objects of the present invention are accomplished by using one of organic iridium compounds represented by formulae (I) to (III) shown below as a resistive film-forming material in the MOD process.

The present invention relates to a resistive film-forming composition essentially containing an organic iridium compound selected from a compound represented by formula (I):

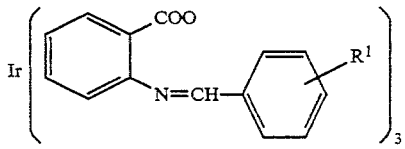

(I)

wherein $R^1$ represents a hydrogen atom, an alkyl group, or an alkoxy group, a compound represented by formula (II):

$$Ir(OOCR^2)_3 \quad \text{(II)}$$

wherein $R^2$ represents an alkyl group, and a compound represented by formula (III):

$$Ir(R^4COCR^3COR^5)_3 \quad \text{(III)}$$

wherein $R^3$ represents a hydrogen atom or an alkyl group; and $R^4$ and $R^5$ each represent an alkyl group.

The present invention further relates to a resistive film formed by coating the above-described composition on a substrate followed by calcining.

The present invention furthermore relates to an electronic component such as a thermal head using the above-described resistive film.

DETAILED DESCRIPTION OF THE INVENTION

Figure 1:
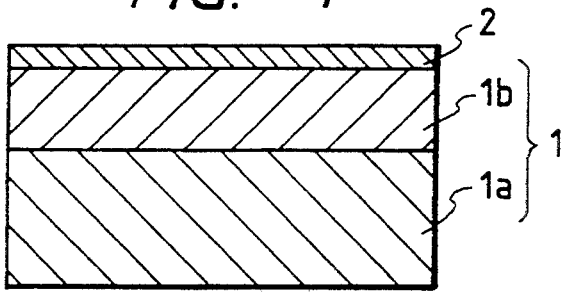
FIG. 1 is a cross section of the resistive film according to the present invention formed on an insulating substrate.

The alkyl or alkoxy group for $R^1$ in formula (I) and the alkyl group for $R^3$, $R^4$ and $R^5$ in formula (III) preferably have 1 to 5 carbon atoms, and the alkyl group for $R^2$ in formula (II) preferably has 2 to 13 carbon atoms.

Specific examples of the organic iridium compounds represented by formula (I) are shown below.

Iridium tris(N-benzylideneanthranilate)

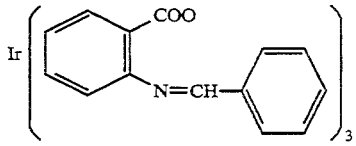

Iridium tris(N-(p-methylbenzylidene)anthranilate)

-continued

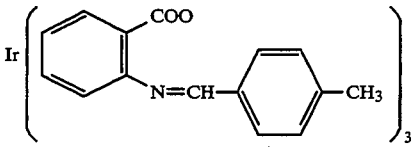

Iridium tris(N-(p-ethylbenzylidene)anthranilate)

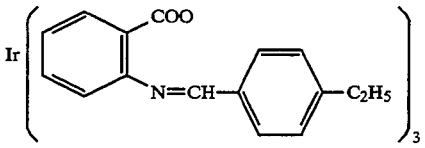

Iridium tris(N-(p-propylbenzylidene)anthranilate)

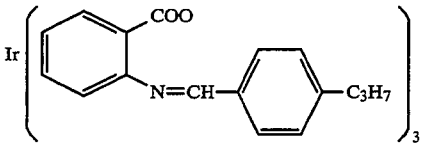

Iridium tris(N-(p-methoxybenzylidene)anthranilate)

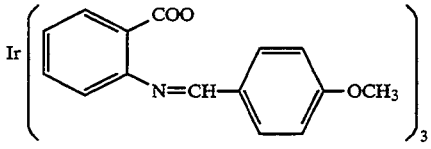

Iridium tris(N-(p-ethoxybenzylidene)anthranilate)

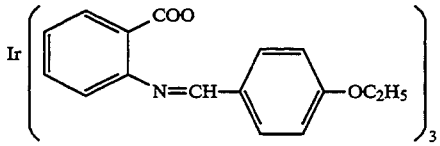

Iridium tris(N-(m-methylbenzylidene)anthranilate)

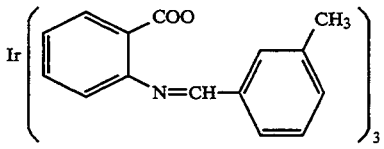

Iridium tris(N-(o-methylbenzylidene)anthranilate)

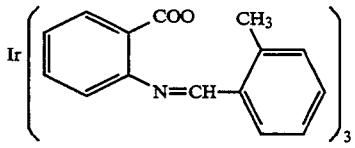

Examples of the iridium compounds represented by formula (II) are shown below.

Iridium propionate [$Ir(OOCC_2H_5)_3$]
Iridium n-butylate [$Ir(OOCC_3H_7)_3$]
Iridium 2-methylpropionate [$Ir[OOCCH(CH_3)_2]_3$]
Iridium n-pentanoate [$Ir(OOCC_4H_9)_3$]
Iridium 2-methylbutyrate [$Ir[OOCCH(CH_3)C_2H_5]_3$]
Iridium 3-methylbutyrate [$Ir[OOCCH_2CH(CH_3)_2]_3$]
Iridium pivalate [$Ir[OOCC(CH_3)_3]_3$]
Iridium n-hexanoate [$Ir(OOCC_5H_{11})_3$]
Iridium n-octanoate [$Ir(OOCC_7H_{15})_3$]
Iridium n-decanoate [$Ir(OOCC_9H_{19})_3$]
Iridium n-dodecanoate [$Ir(OOCC_{11}H_{23})_3$]
Iridium n-tetradecanoate [$Ir(OOCC_{13}H_{27})_3$]
Iridium n-hexadecanoate [$Ir(OOCC_{15}H_{31})_3$]
Iridium n-octadecanoate [$Ir(OOCC_{17}H_{35})_3$]
Iridium oleate [$Ir(OOCC_7H_{14}CH{=}CHC_8H_{17})_3$]

Specific examples of the iridium compounds represented by formula (III) are shown below.

Iridium acetylacetonate (iridium-2,4-pentanedionate) $Ir(CH_3COCHCOCH_3)_3$
Iridium 3,5-heptanedionate [$Ir(C_2H_5COCHCOC_2H_5)_3$]
Iridium 4,6-nonanedionate [$Ir(C_3H_7COCHCOC_3H_7)_3$]
Iridium 2,6-dimethyl-3,5-heptanedionate $Ir[(CH_3)_2CHCOCHCOCH(CH_3)_2]_3$
Iridium 5,7-undecanedionate [$Ir(C_4H_9COCHCOC_4H_9)_3$]
Iridium 3,7-dimethyl-4,6-nonanedionate $Ir[C_2H_5CH(CH_3)_2COCHCOCH(CH_3)C_2H_5]_3$
Iridium 2,8-dimethyl-4,6-nonanedionate $Ir[(CH_3)_2CHCH_2COCHCOCH_2CH(CH_3)_2]_3$
Iridium 2,2,6,6-tetramethyl-3,5-heptanedionate $Ir[(CH_3)_2CCOCCHCOC(CH_3)_3]_3$
Iridium 3-methyl-2,4-pentanedionate [$Ir(CH_3COCCH_3COCH_3)_3$]
Iridium 4-methyl-3,5-pentanedionate [$Ir(C_2H_5COCCH_3COC_2H_5)_3$]
Iridium 5-methyl-4,6-nonanedionate [$Ir(C_3H_7COCCH_3COC_3H_7)_3$]
Iridium 2,4,6-trimethyl-3,5-pentanedionate $Ir[(CH_3)_2CHCOCCH_3COCH(CH_{32}]_3$
Iridium 6-methyl-5,7-undecanedionate [$Ir(C_4H_9COCCH_3COC_4H_9)_3$]
Iridium 3,5,7-trimethyl-4,6-nonanedionate $Ir[C_2H_5CH(CH_3)COCCH_3COCH(CH_3)C_2H_5]_3$
Iridium 2,5,8-trimethyl-4,6-nonanedionate $Ir[(CH_3)_2CHCH_2COCCH_3COCH_2CH(CH_3)_2]_3$
Iridium 2,2,4,6,6-pentamethyl-3,5-heptanedionate $Ir[(CH_3)_3CCOCCH_3COC(CH_3)_3]_3$ The organic iridium compounds can be easiy prepared by known methods. For example, reference can be made to *J. Inorg. Chem.*, 34, 253(1988) and *Mat. Res. Soc. Symp. Proc.*, 60, 35(1986) with respect to synthesis of the compounds of formula (I), and *Inorg. Chem.*, 15(11), 2936(1976) with respect to synthesis of the compounds of formulae (II) and (III).

The organic iridium compound is contained in the resistive film-forming composition of the present invention generally in an amount of 1 to 50 wt % and preferably 3 to 30 wt %.

Other organometallic or organo-non-metallic compounds (hereafter collectively referred to as "organo(non)metallic compounds") may be used in combination with the iridium compounds of formulae (I) to (III).

Examples of the organo(non)metallic compounds are those containing at least one element selected from Si, Bi, Pb, Al, Zr, Ca, Sn, B, Ti and Ba, such as carboxylates, diketone-type chelate compounds, alkoxides or mercaptides of these elements. Preferred are those represented by formulae (IV) to (VI)

$$R^6-\underset{\underset{O}{\|}}{C}-O-X-O-\underset{\underset{O}{\|}}{C}-R^7 \qquad \text{(IV)}$$

-continued

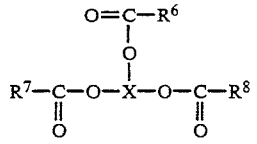

(V)

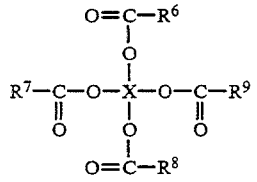

(VI)

wherein $R^6$ to $R^9$, each represents a hydrogen atom or an alkyl group preferably having 1 to 5 carbon atoms, and X represents an element of Si, Bi, Pb, Sn, Al, B, Ti, Zr, Ca or Ba, provided that X is the element having the coordination number in conformity with the respective formula of (IV), (V) and (VI).

Specific examples of the organo(non)metallic compounds are shown below.

Si: Poly(ditolylsiloxane)
$-[-Si(C_6H_4CH_3)_2O-]-_n$
Bi: Bismuth 2-ethylhexanoate
$Bi[OCOCH(C_2H_5)C_4H_9]_3$
Pb: Lead 2-ethylhexanoate
$Pb[OCOCH(C_2H_5)C_4H_9]_2$
Al: Aluminum laurate
$Al(OCOC_{11}H_{23})_3$
Zr: Zirconium oxide 2-ethylhexanoate
$ZrO[OCOCH(C_2H_5)C_4H_9]_2$
Ca: Calcium 2-ethylhexanoate
$Ca[OCOCH(C_2H_5)C_4H_9]_2$
Sn: Tin 2-ethylhexanoate
$Sn[OCOCH(C_2H_5)C_4H_9]_2$
B: Boron 2-ethylhexanoate
$B[OCOCH(C_2H_5)C_4H_9]_3$
Ti: Titanium tetraisopropoxide
$Ti[OCH(CH_3)_2]_4$
Ba: Barium 2-ethylhexanoate
$Ba[OCOCH(C_2H_5)C_4H_9]_2$ These organo(non)metallic compounds are commercially available in the form of metallic or non-metallic resinates, such as Bi resinate(#8365), Si resinate(#28-FC), Pb resinate(#207-1), Pb resinate(#7611), Ca resinate(40B), Pb resinate(207-A), Al resinate(A3808), Zr resinate(#5437), Sn resinate(#118B), B resinate(#11-A), Ti resinate(#9428), and Ba resinate(#137-C), all produced by N.E. CHEMCAT CO.

The organo(non)metallic compound is generally added in the resistive film-forming composition in an amount of 0.1 to 10 moles, preferably 0.5 to 7 moles, and more preferably 1 to 5 moles, per mole of the organic iridium compound.

The resistive film-forming composition of the present invention is prepared by dissolving the organic iridium compound with or without the organo(non)metallic compound in a solvent. As a solvent there may be used a high boiling solvent, preferably from 150° to 300° C., such as terpineol, benzyl acetate, isophorone, butyl carbitol acetate, benzyl alcohol. The solvent may be used singly or as admixture. The resistive film-forming composition generally contains 50 to 70 wt % of the solvent, the balance being solids.

Viscosity of the resistive film-forming composition is preferably adjusted within the range of 3,000 to 30,000 cp. For the purpose, a viscosity adjustor may be added, such as asphalt, cellulose compounds (e.g., ethyl cellulose, nitrocellulose, and carboxymethylcellulose), general-purpose polymers (e.g., polyethylene, polystyrene, polypropylene, polymethyl methacrylate, polyethyl methacrylate, polycarbonate), and natural high molecular compounds (e.g., resins). Of these, asphalt is preferably used singly or in combination with others.

The resistive film of the present invention can be formed by coating the resistive film-forming composition generally in a thickness of 1 to 10 μm, preferably 2 to 5 μm and, after drying, calcining the coated film in good adhesion to the substrate. The calcination temperature is a temperature at which organic substances in the coated film are decomposed and removed, and it is generally from 400° to 900° C. and preferably from 600° to 800° C. The calcination time is from 1 minute to 10 hours and preferably from 30 minutes to 2 hours. The thus formed resistive film of the present invention generally has a thickness of 0.1 to 1 μm and preferably 0.2 to 0.5 μm.

FIG. 1 shows a cross section of resistive film 2 of the present invention obtained by screen-printing the composition in solid on the surface of insulating substrate 1 composed of support 1*a* made of ceramic (e.g., alumina) and under-glaze layer 1*b* and calcining it, as prepared in Examples described below.

Figure 2:
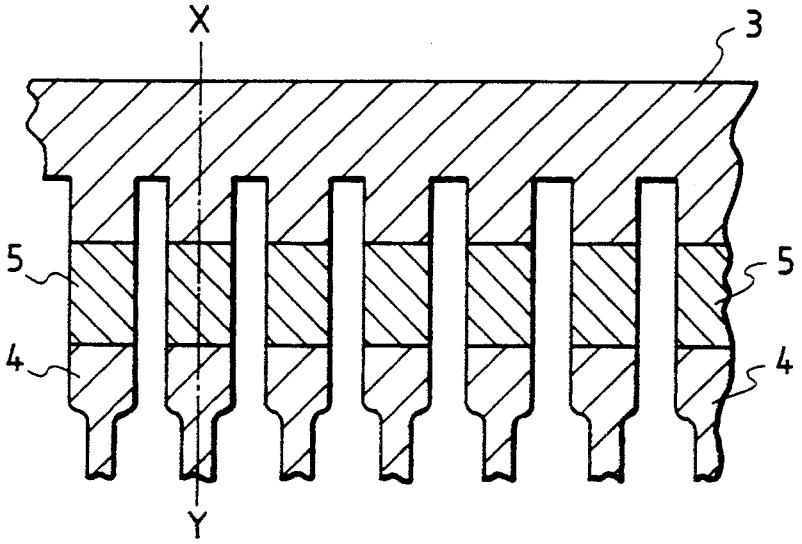
FIG. 2 is a plane view of the thermal head using the resistive film according to the present invention.
Figure 3:
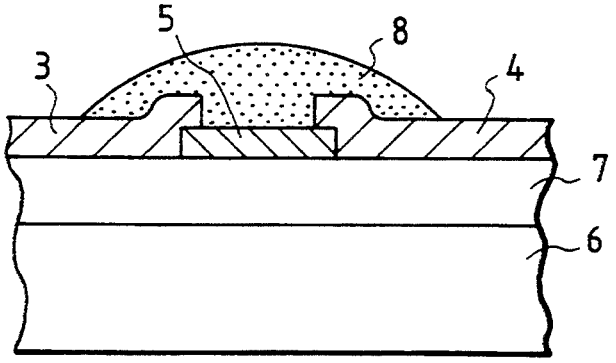
FIG. 3 is a cross section of the thermal head shown in FIG. 2 along X-Y line.

The resistive film can be used as a heating element of electronic component such as thermal heads. FIGS. 2 and 3 show a plane view and a cross section, respectively, of thermal head utilizing the resistive film of the present invention, wherein 3 is a common electrode, 4 a counter electrode, 5 a resistive film, 6 an alumina support, 7 an under-glaze layer, and 8 an over-glaze layer. The thermal head can be produced by the following manner. First, a resistive film is formed as a heating element on a glazed alumina support (having under-glaze layer 7 formed on alumina support 6), and a photoresist is then provided thereon, followed by imagewise exposure and development, whereby a resist pattern is formed on the resistive film. Then, uncovered portions of the resistive film are etched to form 8 to 24 dot/mm-resistant pattern 5, on which a metalloorganic gold past D27 produced by NORITAKE CO., LTD. is uniformly coated and calcined to form a gold film. Thereafter, a photoresist is coated on the gold film, imagewise exposed to light and developed to form a resist pattern for a common electrode and a counter electrode, and uncovered portions of the gold film are etched with an iodine-potassium iodide ($I_2$.KI) solution to form a conductive pattern. Subsequently, a glass paste 490 BH produced by Electro-Science Laboratory Co. is printed on each element as a protective layer and calcined to formover-glaze layer 8. The resistive film of the thus produced thermal head exhibits relatively uniform resistivity and small variation in resistivity on voltage application.

The present invention is now illustrated in greater detail with reference to Examples.

EXAMPLE 1

Iridium tris(N-benzylideneanthranilate), poly(ditolylsiloxane) and bismuth 2-ethylhexanoate were mixed at such a ratio that the Ir:Si:Bi atomic ratio after calcining became 1:1:1. The viscosity of the mixture was adjusted to 3,000 to 20,000 cps with a solvent, e.g., α-terpineol, butylcarbitol acetate, etc. The thus prepared resistive film-forming composition was screen-printed in solid on insulating substrate 1 using a stainless steel screen of 100 to 400 mesh.

The printed substrate was dried at 120° C. and then calcined in an infrared belt calcination furnace at a peak temperature of 800° C. for 10 minutes to form resistive film 2 having a thickness of from 0.1 to 0.5 μm. The resistive film was not peeled in a Scotch tape test, exhibiting satisfactory adhesion to the substrate. The surface resistivity of the resistive film was about 450 Ω/square, calculated based on 0.2 μm thickness.

EXAMPLE 2

A resistive element was produced in the same manner as in Example 1, except for using the following resistive film-forming composition.

Iridiumtries(N-(p-ethylbenzylidene)anthranilate), lead 2-ethylhexanoate, and barium 2-ethylhexanoate were mixed at such a ratio that the Ir:Pb:Ba atomic ratio after calcination became 1:1:1, and the viscosity was adjusted in the same manner as in Example 1.

The resulting resistive film had a thickness of from 0.05 to 0.4 μm and exhibited satisfactory adhesion to the substrate in a Scotch tape test. The surface resistivity was about 2 kΩ/square, calculated based on 0.2 μm thickness.

EXAMPLE 3

A resistive element was produced in the same manner as in Example 1, except for using the following resistive film-forming composition.

Iridium tries(N-(p-methoxybenzylidene)anthranilate), zirconium 2-ethylhexanoate, and tin 2-ethylhexanoate were mixed at such a ratio that the Ir:Zr:Sn atomic ratio after calcination became 2:1:1, and the viscosity was adjusted in the same manner as in Example 1.

The resulting resistive film had a thickness of from 0.05 to 0.4 μm and exhibited satisfactory adhesion to the substrate in a Scotch tape test. The surface resistivity was about 6 kΩ/square, calculated based on 0.2 μm thickness.

EXAMPLE 4

A resistive element was produced in the same manner as in Example 1, except for using the following resistive film-forming composition.

Iridium pivalate, poly(ditolylsiloxane), and bismuth 2-ethylhexanoate were mixed at such a ratio that the Ir:Si:Bi atomic ratio after calcination became 1:1:1, and the viscosity was adjusted in the same manner as in Example 1.

The resulting resistive film had a thickness of from 0.1 to 0.5 μm and exhibited satisfactory adhesion to the substrate in a Scotch tape test. The surface resistivity was about 450 Ω/square, calculated 0.2 μm thickness.

EXAMPLE 5

A resistive element was produced in the same manner as in Example 1, except for using the following resistive film-forming composition.

Iridium 3-methylbutyrate, lead 2-ethylhexanoate, and calcium 2-ethylhexanoate were mixed at such a ratio that the Ir:Pb:Ca atomic ratio after calcination became 2:1:1, and the viscosity was adjusted in the same manner as in Example 1.

The resulting resistive film had a thickness of from 0.1 to 0.5 μm and exhibited satisfactory adhesion to the substrate in a Scotch tape test. The surface resistivity was about 250 Ω/square, calculated based on 0.2 μm thickness.

EXAMPLE 6

A resistive element was produced in the same manner as in Example 1, except for using the following resistive film-forming composition.

Iridium oleate, zirconium 2-ethylhexanoate, and titanium tetraisopropoxide were mixed at such a ratio that the Ir:Zr:Ti atomic ratio after calcination became 2:1:1, and the viscosity was adjusted in the same manner as in Example 1.

The resulting resistive film had a thickness of from 0.1 to 0.4 μm and exhibited satisfactory adhesion to the substrate in a Scotch tape test. The surface resistivity was about 9 kΩ/square, calculated 0.2 μm thickness.

EXAMPLE 7

A resistive element was produced in the same manner as in Example 1, except for using the following resistive film-forming composition.

Iridiumacetylacetonate, poly(ditolylsiloxane), and bismuth 2-ethylhexanoate were mixed at such a ratio that the Ir:Si:Bi atomic ratio after calcination became 1:1:1, and the viscosity was adjusted in the same manner as in Example 1.

The resulting resistive film had a thickness of from 0.1 to 0.5 μm and exhibited satisfactory adhesion to the substrate in a Scotch tape test. The surface resistivity was about 450 Ω/square, calculated based on 0.2 μm thickness.

EXAMPLE 8

A resistive element was produced in the same manner as in Example 1, except for using the following resistive film-forming composition.

Iridium 2,2,6,6-tetramethyl-3,5-heptanedionate, lead 2-ethylhexanoate, and aluminum laurate were mixed at such a ratio that the Ir:Pb:Al atomic ratio after calcination became 2:2:1, and the viscosity was adjusted in the same manner as in Example 1.

The resulting resistive film had a thickness of from 0.1 to 0.5 μm and exhibited satisfactory adhesion to the substrate in a Scotch tape test. The surface resistivity was about 300 Ω/square, calculated based on 0.2 μm thickness.

EXAMPLE 9

A resistive element was produced in the same manner as in Example 1, except for using the following resistive film-forming composition.

Iridium 3-methyl-2,4-pentanedionate, zirconium 2-ethylhexanoate, and boron 2-ethylhexanoate were mixed at such a ratio that the Ir:Zr:B atomic ratio after calcination became 2:1:1, and the viscosity was adjusted in the same manner as in Example 1.

The resulting resistive film had a thickness of from 0.1 to 0.5 μm and exhibited satisfactory adhesion to the substrate in a Scotch tape test. The surface resistivity was about 7 kΩ/square, calculated based on 0.2 μm thickness.

The resistive film-forming composition mainly comprising the organic iridium compound as exemplified in the foregoing examples is gradually burnt to form a resistive film uniformly containing iridiumoxide ($IrO_2$).

The resulting resistive film has homogeneity on the submicron level, is free from cracks or pinholes, and exhibits high adhesive strength to the substrate. Thus, the resistive films obtained in the Examples show little variation in resistivity, high strength against electric field or power, and small variation in resistivity on voltage application.

The foregoing working Examples are only illustrative, allowing addition of various alterations as long as such fall within the scope of the present invention. For example, the resistive film-forming compositions may further contain additives, such as viscosity modifiers. Resistive film-forming compounds other than those actually employed in the working examples can also be used. The viscosity of the resistive film-forming composition, calcination temperature, calcination time and other production conditions are subject to variation depending on the materials to be used. In addition to screen printing adopted in the examples, dip coating, roll coating, spin coating, ink jet coating, and the like may be used for coating the resistive film-forming composition on the insulating substrate.

While the invention has been described in detail and with reference to specific examples thereof, it will be apparent to one skilled in the art that various changes and modifications can be made therein without departing from the spirit and scope thereof.

What is claimed is:

1. A resistive film-forming composition to be coated on a substrate and calcined to form a resistive film, which contains an organic iridium compound selected from a compound represented by formula (I):

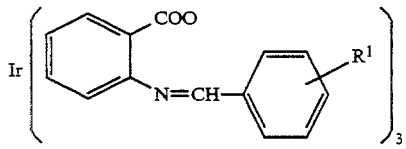

(I)

wherein $R^1$ represents a hydrogen atom, an alkyl group, or an alkoxy group, a compound represented by formula (II):

$$Ir(R^4COCR^3COR^5)_3$$

wherein $R^3$ represents a hydrogen atom or an alkyl group; and $R^4$ and $R^5$ each represent an alkyl group.

2. A resistive film-forming composition as claimed in claim 1, which further contains a solvent capable of dissolving said organic iridium compound.

3. A resistive film-forming composition as claimed in claim 2, which further contains a viscosity adjustor.

4. A resistive film-forming composition as claimed in claim 3, which further contains an organometallic or organo-non-metallic compound for adjustment of resistivity of a resistive film.

5. A resistive film-forming composition as claimed in claim 4, wherein said organometallic or organo-non-metallic compound contains at least one element selected from the group consisting of silicon, bismuth, lead, aluminum, zirconium, calcium, tin, boron, titanium, and barium.

6. A resistive-film-forming composition as claimed in claim 1, wherein said organic iridium compound is contained in an amount of 1 to 50 wt % based on the weight of the resistive film-forming composition.

7. A resistive film-forming composition as claimed in claim 5, wherein said organometallic or organo-non-metallic compound is contained in an amount of 0.1 to 10 moles per mole of said organic iridium compound.

8. A resistive film-forming composition as claimed in claim 1, wherein said iridium compound is

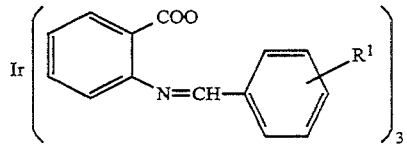

(I)

9. A resistive film-forming composition as claimed in claim 1, wherein the organic iridium compound is $$Ir(R^4COCR^3COR^5)_3 \quad \text{(II)}$$

10. A resistive film-forming composition as claimed in claim 1, wherein said organic iridium compound is a tris benzylideneanthranilate selected from the group consisting of Iridium propionate, Iridium n-butylate, Iridium 2-methylpropionate, Iridium n-pentanoate, Iridium 2-methylbutyrate, Iridium 3-methylbutyrate, Iridium pivalate, Iridium n-hexanoate, Iridium n-octanoate, Iridium n-decanoate, Iridium n-dodecanoate, Iridium n-tetradecanoate, Iridium n-hexadecanoate, Iridium n-octadecanoate and Iridium oleate.

11. A resistive film-forming composition as claimed in claim 1, wherein said organic iridium compound is a dionate selected from the group consisting of Iridium acetylacetonate, Iridium 3,5-heptanedionate, Iridium 4,6-nonanedionate, Iridium 2,6-dimethyl-3,5-heptanedionate, Iridium 5,7-undecanedionate, Iridium 3,7-dimethyl-4,6-nonanedionate, Iridium 2,8-dimethyl-4,6-nonanedionate, Iridium 2,2,6,6-tetramethyl-3,5-heptanedionate, Iridium 3-methyl-2,4-pentanedionate, Iridium 4-methyl-3,5-pentanedionate, Iridium 5-methyl-4,6-nonanedionate, Iridium 2,4,6-trimethyl-3,5-pentanedionate, Iridium 6-methyl-5,7-undecanedionate, Iridium 3,5,7-trimethyl-4,6-nonanedionate, Iridium 2,5,8-trimethyl-4,6-nonanedionate, and Iridium 2,2,4,6,6-pentamethyl-3,5-heptanedionate.

* * * * *